US006552494B2

(12) United States Patent
Randazzo et al.

(10) Patent No.: US 6,552,494 B2
(45) Date of Patent: Apr. 22, 2003

(54) FLUORESCENT LAMP DRIVER CIRCUIT

(75) Inventors: Vincenzo Randazzo, Biancavilla (IT); Atanasio La Barbera, Mascalucia (IT)

(73) Assignee: STMicroelectronics s.r.l., Agrate Brianza MI (IT)

( * ) Notice: Subject to any disclaimer, the term of this patent is extended or adjusted under 35 U.S.C. 154(b) by 0 days.

(21) Appl. No.: 10/062,311

(22) Filed: Jan. 31, 2002

(65) Prior Publication Data

US 2002/0140357 A1 Oct. 3, 2002

(30) Foreign Application Priority Data

Feb. 9, 2001 (IT) ..... MI2001A000261

(51) Int. Cl.[7] ..... H05B 39/04

(52) U.S. Cl. ..... 315/106; 315/107; 315/177; 315/46; 315/49; 315/94

(58) Field of Search ..... 315/106, 107, 315/105, 177, 46, 48, 49, 59, 60, 94

(56) References Cited

U.S. PATENT DOCUMENTS 5,338,110 A * 8/1994 Byun ..... 315/94
6,043,606 A * 3/2000 Arts et al. ..... 315/94
6,307,329 B1 * 10/2001 Beij et al. ..... 315/224
6,346,779 B1 * 2/2002 Aiello ..... 315/291

* cited by examiner

*Primary Examiner*—Don Wong
*Assistant Examiner*—Tuyet T. Vo
(74) *Attorney, Agent, or Firm*—Hogan & Hartson, LLP

(57) ABSTRACT

Herein described is a driver circuit of a fluorescent lamp having a first and a second electrode and igniting when the voltage between the first and second Electrode exceeds a given threshold voltage. The driver circuit comprises an inductance coupled to a supply voltage and to a terminal of the first electrode a first condenser coupled to the other terminal of the first electrode and to a terminal of the second electrode, a control device comprising a first and a second system of switches capable of guaranteeing oscillations of a voltage signal on the inductance and on the first condenser up to the ignition of the lamp. The driver circuit comprises a device associated to the control device and capable of acting on the first system of switches so as to regulate the frequency of the oscillations from a frequency greater than the resonance frequency of the inductance and of the first condenser to the same resonance frequency so as to guarantee a preheating of the first and second electrodes. The device is sensitive to the depletion of gas of the lamp and is capable of sending a turn-off signal to the control device.

11 Claims, 9 Drawing Sheets

FLUORESCENT LAMP DRIVER CIRCUIT

BACKGROUND OF THE INVENTION

The present invention refers to a fluorescent lamp driver circuit.

Fluorescent lamps are generally composed of a glass tube 1 which contains fluorescent gas 2 and at the ends of which there are two electrodes F1 and F2, as shown in FIG. 1. Under normal conditions the lamp is assimilable to an open circuit and presents an infinite impedance between its electrodes, as shown in diagram I(V) of FIG. 2. If the voltage between its electrodes exceeds a threshold voltage Vth the lamp ignites as there is an ionization of the gas 2 by means of emission of electrons by the two electrodes. The value of the voltage Vth depends on the temperature of the two electrodes given that, at equal voltage applied, as the temperature increases the quantity of electrons emitted increases and therefore at a higher temperature of the electrodes corresponds a voltage Vth of lower value. Once the threshold voltage Vth is exceeded the gas 2 changes state and the tube 1 becomes assimilable to a resistive load; so that said condition remains it is necessary to supply a small current Imin.

Fluorescent lamps must be driven by circuits that are capable of permitting their turning on and off, like the circuit shown in FIG. 3. A first block 31 converts an alternating voltage, generally a mains voltage, into a direct voltage between Vdd and ground Gnd. To a terminal of the voltage Vdd is connected a resistor R2 connected in turn to an inductance L1 connected with a terminal P1 of the electrode F1 of the fluorescent lamp. The other terminal P2 of the electrode F1 is connected to a terminal of a capacitance C3 connected in turn to a terminal P4 of the electrode F2; the other terminal P3 of the electrode F2 is connected to a condenser C1 connected to the voltage Vdd and to a condenser C2 connected to ground Gnd. The inductance L1 and the condenser C3 form a circuit L-C series. Two secondaries Ls1 and Ls2 are wound on the inductance L1 that transfer the state of the circuit L-C to the control logic formed by two blocks 32 and 33. The block 32 comprises a diode DIAC 34 connected to a resistor R1 connected to the voltage Vdd and connected to a condenser C4 having the other terminal grounded Gnd; the DIAC 34 is capable of giving a first impulse to a system of switches 35 then disabling itself. The system of switches 34 acts so that the circuit L-C series begins to oscillate at a resonance frequency given by $$fr\frac{1}{2\Sigma L1C3},$$

which generally has a value comprised between 60 Khz and 70 Khz, and there will be a square wave signal of frequency fr and amplitude Vdd in a node PC on the terminals in common of the inductance L1 and of the resistor R2. The resonant circuit L-C shall determine overvoltages on the condenser C3 such that after a few cycles of oscillation the value of the threshold voltage Vth is exceeded causing the ignition of the fluorescent lamp. Between the nodes PC and P3 there will no longer be the resonant circuit L-C but a circuit R-L1 where R is the resistor of the fluorescent lamp and the control logic inside the blocks 32 and 33 will determine the working frequency, generally between 30 Khz and 50 Khz. The block 33 is similar to the block 32 but does not comprise the diode Diac 34 and instead comprises a system of switches 101 similar to the system of switches 35 of the block 32.

In the place of the two blocks 32 and 33 and of the respective inductances Ls1 and Ls2 an integrated circuit 41, as shown in FIG. 4, that controls the operations described above, can be inserted in the circuit of FIG. 3.

THE SUMMARY OF THE INVENTION

To increase the life of the fluorescent lamp a function of preheating of the electrodes F1 and F2 is required, in the phase prior to the ignition of the lamp; said preheating of the electrodes F1 and F2 enables them to be more emissive and to obtain a threshold voltage Vth of lower value. A circuit 51 that implements the preheating function is shown in FIG. 5; said circuit 51 comprises a condenser C6 inserted between the terminal P4 and a terminal of the condenser C3 and placed in parallel with a block PTC that comprises a resistor variable with the temperature. The preheating function is carried out by passing a current through the electrodes F1 and F2 that is the same as the current that passes through the oscillating circuit L-C where at the beginning, seeing the PTC is a low impedance, the C corresponds to C3 which is chosen sufficiently big so as not to generate high voltages near the threshold voltage Vth. The heating of the PTC causes an increase of its resistance and after a certain time it presents an infinite impedance at the limit. In this case the capacitor C of the resonant circuit L-C is given by the series of condensers C3 and C6 and the value of C6 must be chosen much lower than C3. The capacitive impedance is high and such as to generate at its ends a higher voltage than the threshold voltage Vth and therefore ignites the lamp.

In particular applications where the replacement of the worn fluorescent lamp is envisaged, a protection function of the lamp driver circuit called "End of life" is required. In fact if the gas in the lamp is depleted, the lamp will never ignite and the driver circuit will remain in perpetual free oscillation with high overvoltages and overcurrents that lead to the destruction of the driver circuit of the lamp.

In FIG. 6 a driver circuit is shown in which the End of Life function is made by means of a block 61 comprising a series of elements connected in series between the terminal P1 and ground Gnd: a condenser C7, a diode Zener Dz1, a resistor R3, a condenser C8. A condenser Cp is placed in parallel with the elements Dz1, R3 and C8, while a resistor R4 is placed in parallel with only the condenser C8. A diode Zener Dz2 is connected to the terminal in common with the elements R3 and C8, connected to a turn-off block of the type SCR 62 connected to the block 32, to the terminal in common of the elements R1 and C4 and a ground. With the lamp ignited the voltage value on the terminal P1 is low and therefore the voltage value on the element Cp does not exceed the breakdown voltage BVDz1 of the diode Dz1. In the phase prior to the ignition of the lamp the terminal P1 reaches high voltage values, generally between 0,8 KV and 1 KV, and therefore the voltage on the element Cp manages to exceed the voltage BVDz1; in that case current flows through the condenser C8 whose value is limited to the resistor R3. The time constant of R3 and C8 is a very few seconds, generally 2 or 3 seconds, therefore in conditions of normal ignition with or without preheating the voltage at the ends of the element C8 does not exceed the breakdown voltage BVDz2 of the diode Dz2. In condition of gas depleted in the lamp the driver circuit remains in perpetual free oscillation and that implies that on the condenser C8 current continues to flow; the voltage at the ends of C8 exceeds the voltage BVDz2 and that enables the activation of the turn-off block 62. This block causes the turn-off of the block 32 causing the stop of the oscillations and impedes the voltage on the element C4 from reaching an ignition value of the block 32.

In view of the state of the technique described, object of the present invention is to present a driver circuit for fluorescent lamps which is simpler than known circuits and carries out the functions of preheating and end of life.

In accordance with the present invention, said object is reached by means of a driver circuit of a fluorescent lamp having a first and a second electrode and igniting when the voltage between said first and second electrode exceeds a given threshold voltage, said driver circuit comprising a inductance coupled to a supply voltage and to a terminal of said first electrode, a first condenser coupled to the other terminal of said first electrode and to a terminal of said second electrode, a control device comprising a first and a second system of switches capable of guaranteeing oscillations of a voltage signal on said inductance and on said first condenser up to the ignition of said lamp, characterized in that it comprises a device associated to said control device and capable of acting on said first system of switches so as to regulate the frequency of said oscillations from a frequency greater than the resonance frequency of said inductance and of said first condenser to the same said resonance frequency so as to guarantee a preheating of said first and second electrode, said device being sensitive to the depletion of gas of said lamp and being capable of sending a turn-off signal to said control device.

Thanks to the present invention a driver circuit for fluorescent lamps can be made which is simpler than the known circuits and comprises less expensive elements.

BRIEF DESCRIPTION OF THE DRAWINGS

The characteristics and advantages of the present invention will appear evident from the following detailed description of an embodiment thereof, illustrated as non-limiting example in the enclosed drawings, in which.

DETAILED DESCRIPTION

Figure 1:
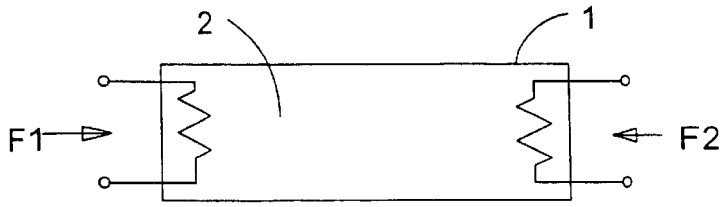
FIG. 1 is a schematic view of a fluorescent lamp.
Figure 2:
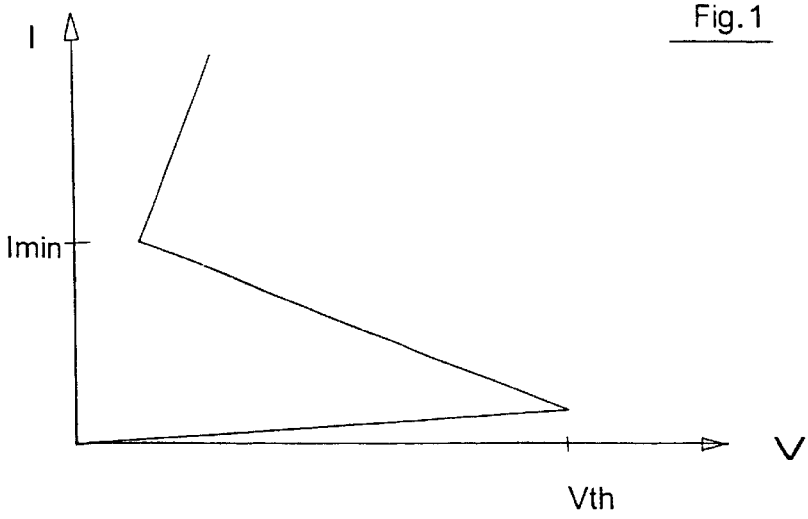
FIG. 2 is a graph of the current of the lamp of FIG. 1 in function of the voltage on the electrodes of the lamp.
Figure 3:
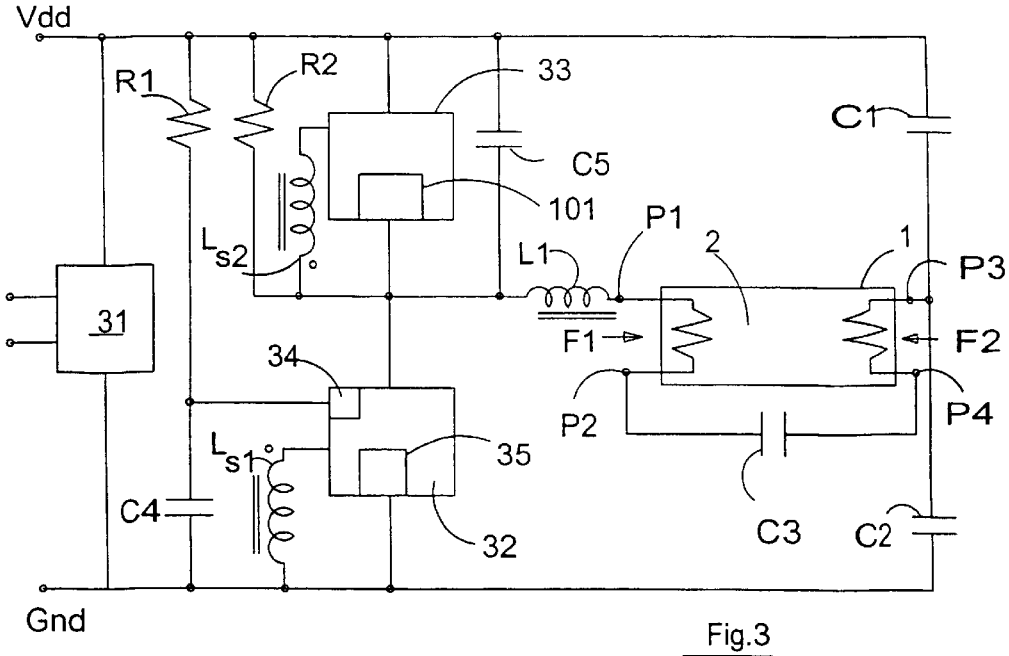
FIG. 3 is a first circuit diagram of a driver circuit for the lamp of FIG. 1 according to the known art.
Figure 4:
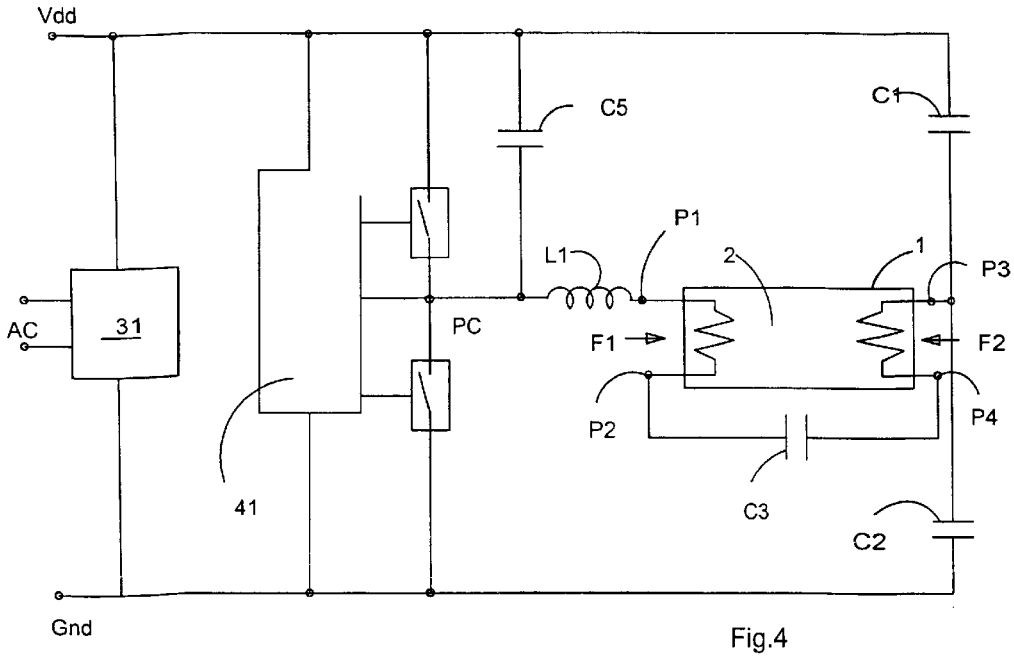
FIG. 4 is a second circuit diagram of a driver circuit for the lamp of FIG. 1 according to the known art.
Figure 5:
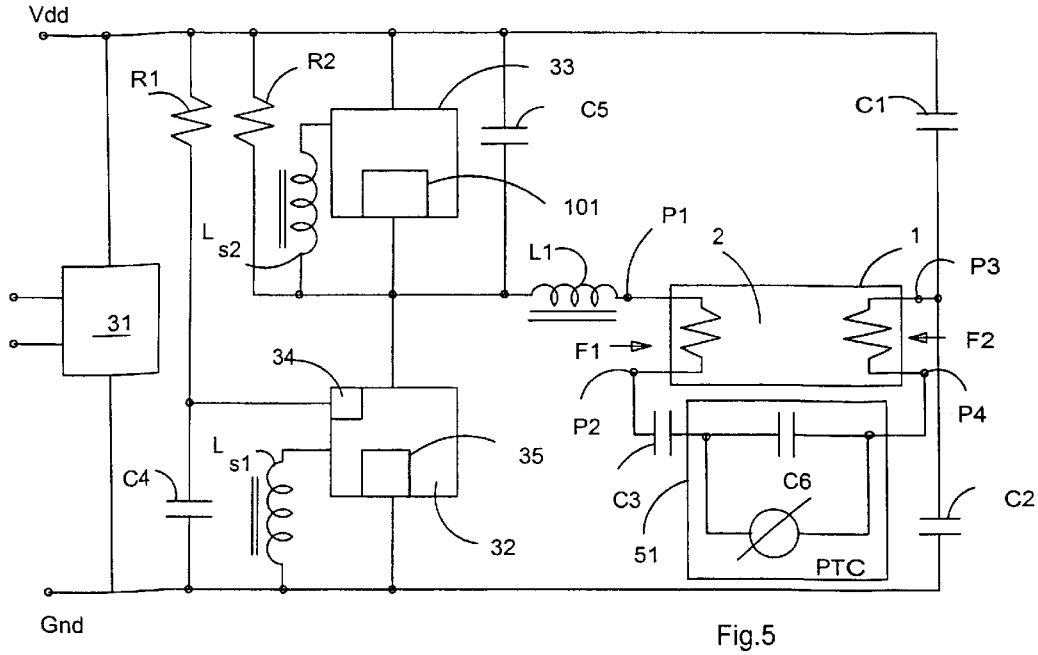
FIG. 5 is a circuit diagram of the driver circuit of FIG. 4 with a device for implementing the preheating function.
Figure 6:
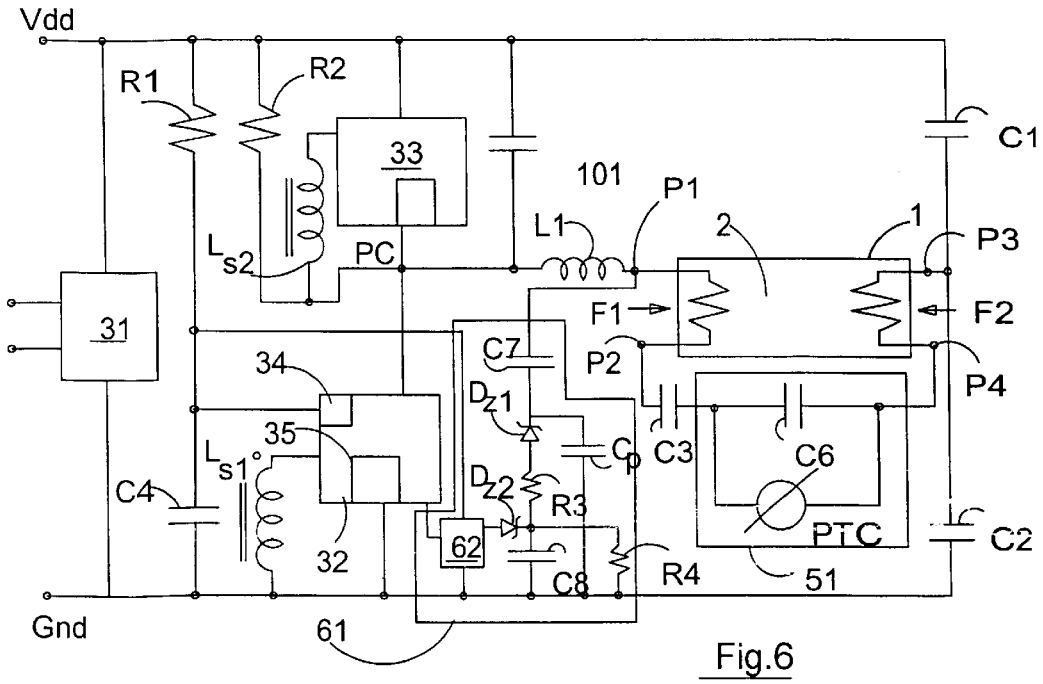
FIG. 6 is a circuit diagram of the driver circuit of FIG. 5 with a device for implementing the end of life function.
Figure 7:
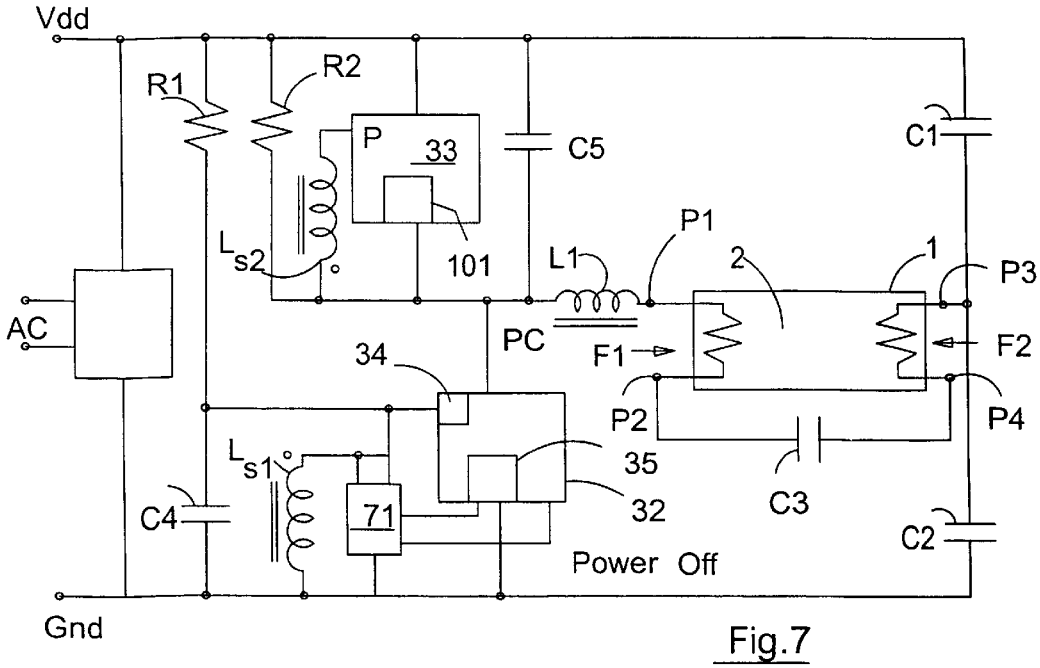
FIG. 7 is a circuit diagram of a driver circuit for the lamp of FIG. 1 according to a first embodiment of the invention.

A circuit diagram of a driver circuit for the lamp of FIG. 1 according to a first embodiment of the invention is shown with reference to FIG. 7. said driver circuit is similar to the circuit of FIG. 3 except for the presence of a device 71 capable of carrying out the functions of preheating and end of life; the same circuit elements will be indicated by the same numeric references. The device 71 is connected to the inductance Ls1 of the secondary and to the block 32 comprising a system of switches 35 whose closing and opening frequency fint is controlled by the device 71. Said device 71 is capable of sending a Power off signal to turn off the block 32 and to impede Diac 34 from sending pulses for new oscillations of the system.

Figure 8:
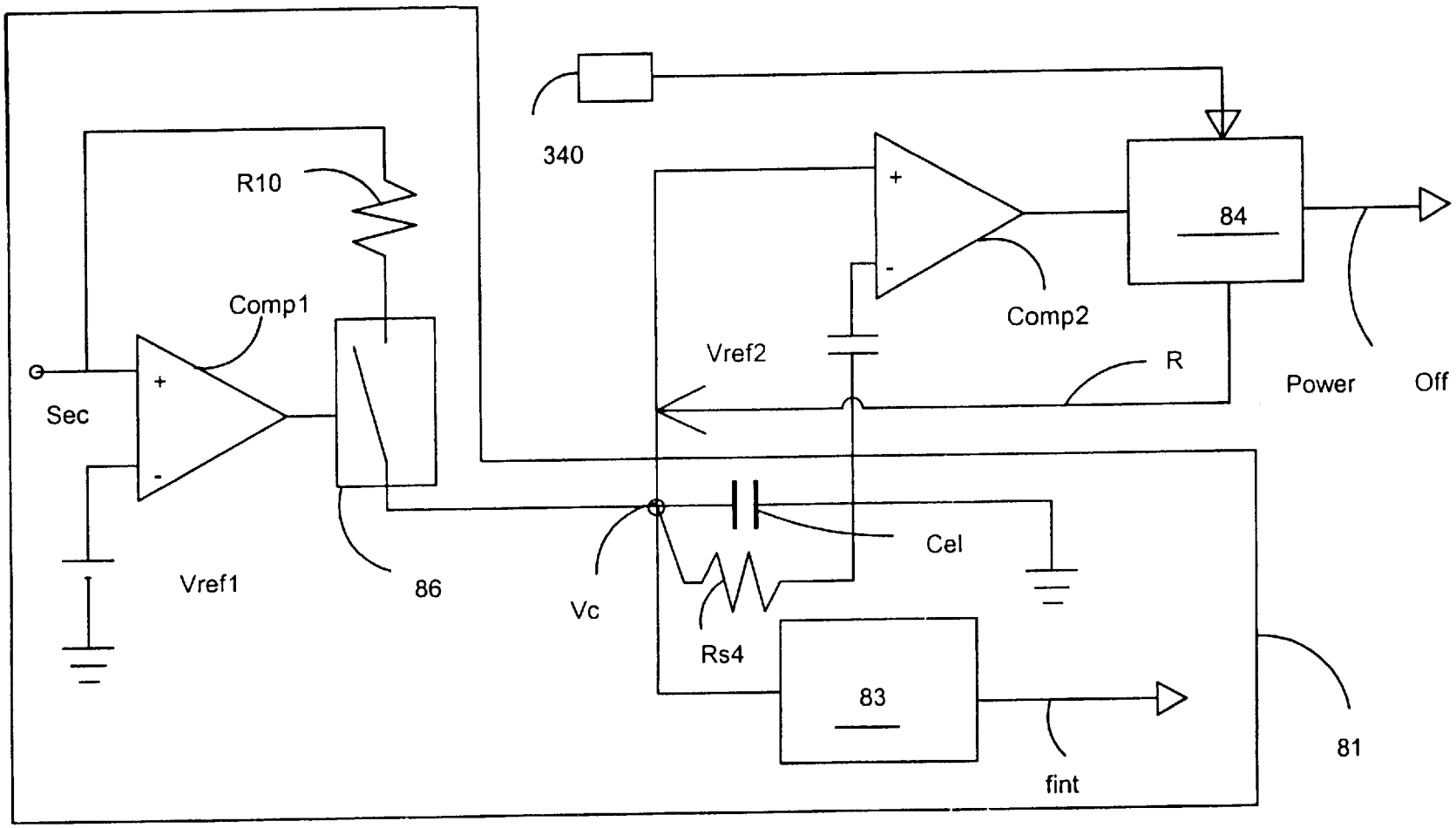
FIG. 8 is a circuit diagram of the preheating device and the end of life device of the circuit of FIG. 7.

The device 71 of FIG. 7 is shown in FIG. 8 which comprises a block 81 which constitutes the only preheating circuit while the entire device 71 also carries out the end of life function.

The block 81, which is drawn with a dotted line in FIG. 8, comprises: a comparator Comp1 capable of comparing a voltage signal Sec coming from the secondary with the inductance Ls1 and a reference signal Vref1. The signal in output from the comparator Comp1 controls a switch 86 capable of connecting a resistor R10, connected to the secondary Ls1, to an electrolytic capacitance Cel of a high value connected to ground. The capacitor Cel is connected to a block 83, capable of controlling the frequency fint opening and closing the system of switches 35 that guarantees a square wave signal of frequency f on the node PC. The block 83 therefore controls said frequency f in dependency on a voltage Vc at the ends of the capacitor Cel; more precisely the block 83 starting from a frequency f greater than that of oscillation fr of the circuit L-C series formed by the inductance L1 and by the capacitor C3, tends to lower said frequency f in function of the voltage Vc up to arrive at said frequency of oscillation fr. In this manner given that at frequencies f greater than the frequency of oscillation fr the voltage on the condenser C3 is lower than the voltage Vth of ignition of the fluorescent lamp, it is possible to activate a preheating of the filaments F1 and F2 of the lamp by means of the same current that flows in the circuit L1-C3. Said heating has a duration that is chosen on the basis of the dimensions of the capacitor Cel, for example 0,5 s, 1 s or 2 s. The block 83 has a characteristic which is inversely proportional to the voltage Vc, that is f inversely proportional to Vc, and tends to lead to f being equal to fr; with f=fr we have, after several cycles of oscillation, the ignition of the lamp. Once the ignition of the lamp has come about, the voltage Sec on the secondary diminishes to the same degree the current that circulates on the inductance L1 diminishes; the capacitor Cel can discharge through a resistor Rs4 placed in parallel with it and of high value when the circuit is no longer supplied by the mains voltage.

The device 71 of FIG. 8 comprises in addition to the block 81 also a comparator Comp2 capable of comparing the voltage Vc with a reference voltage Vref2 where Vref2>Vref1, and a turn-off block 84 which is supplied through the supply circuit R1-C4 of the Diac 34 of the circuit of FIG. 7, schematized in the figure by a block 340, and, once activated, sees to turning-off the block 32 by means of the signal Power off. Starting from the condition in which the frequency f is equal to the frequency fr, if the lamp is not ignited (that is in conditions of depleted gas in the lamp), the voltage Sec on the secondary continues to increase and consequently also the voltage Vc increases. When the voltage Vc exceeds the voltage Vref2 the comparator Comp2 activates the turn-off block 84 that confirms the load on Cel by means of the retroaction R, turns off the block 32 with the signal Power off and, given that it is supplied through the same supply circuit as the Diac, impedes the Diac to send impulses for new oscillations of the system.

Figure 8A:
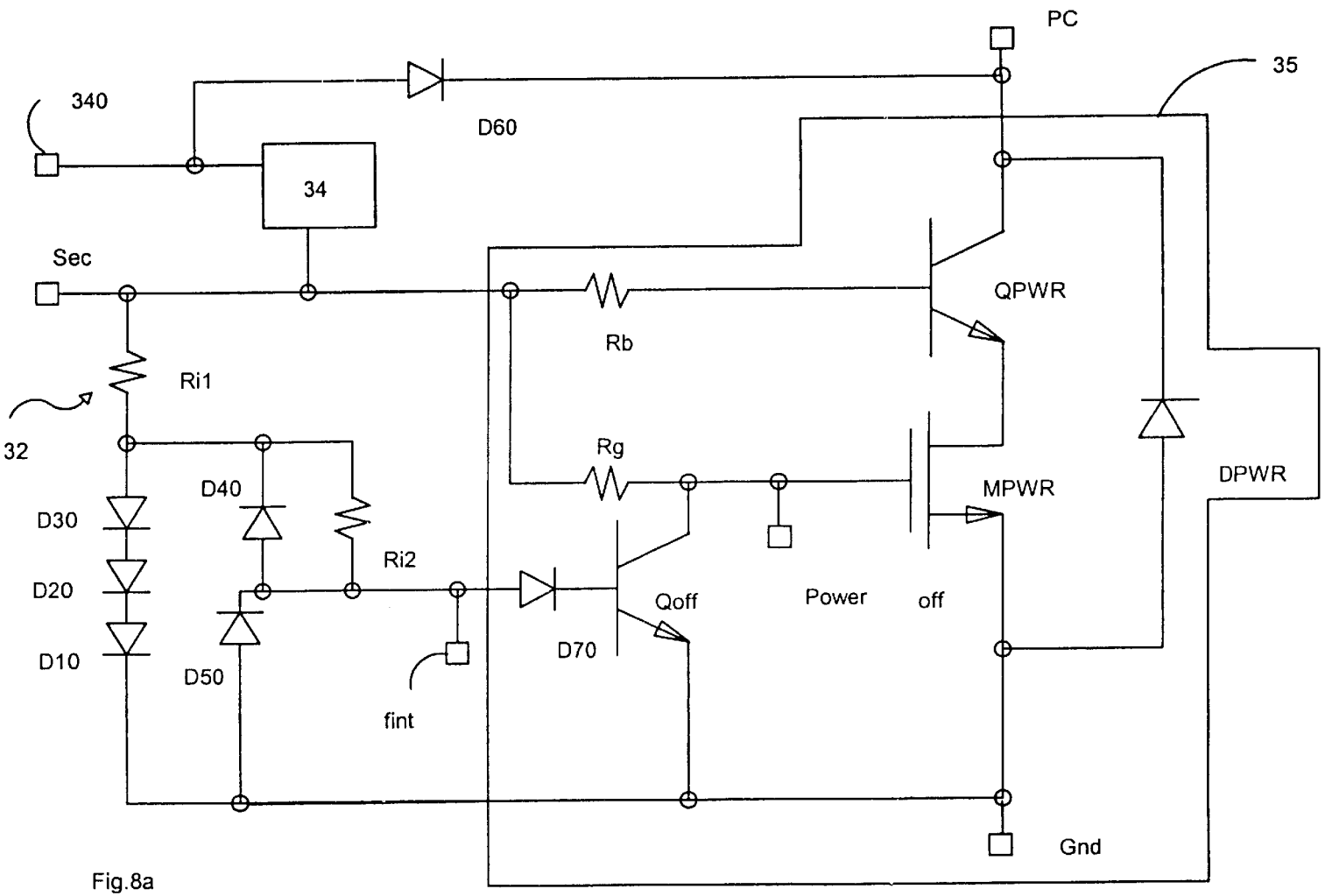
FIG. 8*a* is an example of circuit implementation of the block 32 of the circuit of FIG. 7.

An example of circuit implementation of the block 32 of the circuit of FIG. 7 is shown in FIG. 8*a*. Said block 32 comprises the diode Diac 34 connected to the secondary Sec and to the mains block 340 and to the anode of a diode D60 having the cathode connected to the node PC. The block 32 comprises a block of diodes formed by diodes D10–D30 connected in series with the cathode of the diode D10 connected to ground Gnd and the anode of the diode D30 coupled by means of the resistor Ri1 to the secondary Sec, and two diodes D40–D50 connected in series with the anode of the diode D50 connected to ground and the cathode of the diode D40 coupled by means of the resistor Ri1 to the secondary Sec; a resistor Ri2 is placed in parallel to the diode D40. The system of switches 35 comprises a diode D70 whose anode is connected to the anode of the diode D40 and whose cathode is connected to the base terminal of a transistor npn Qoff having the emitter terminal grounded Gnd and the collector terminal coupled to the secondary Sec by means of a resistor Rg, a transistor NMOS MPWR having the source terminal connected to ground, the gate terminal connected to the collector terminal of the transistor Qoff, the drain terminal connected to the emitter terminal of a transistor npn QPWR having the base terminal coupled to the secondary Sec by means of a resistor Rb and the collector terminal connected to the node PC, a diode DPWR having the anode connected to the source terminal of the transistor MPWR and the cathode connected to the node PC.

Figure 8B:
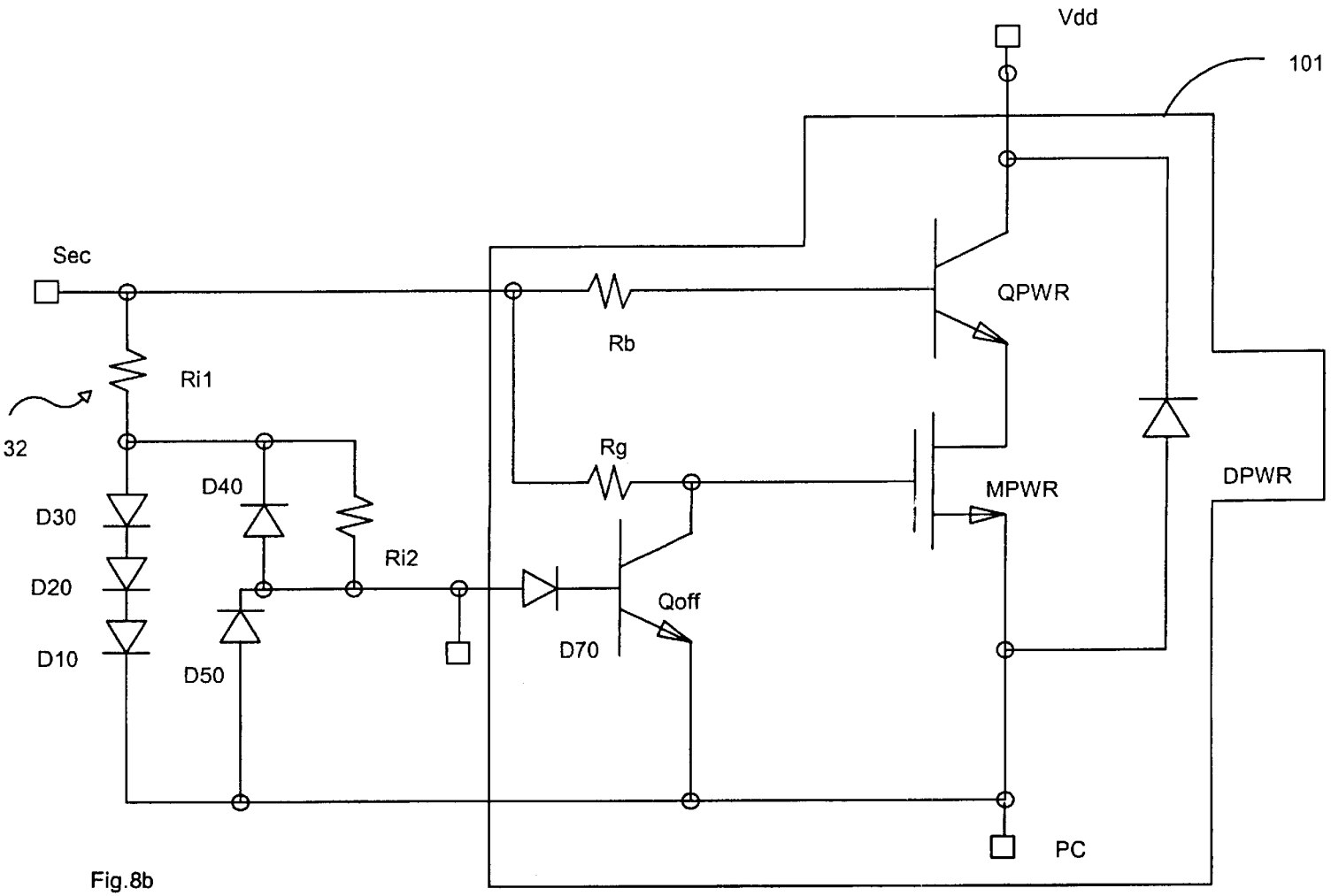
FIG. 8*b* is an example of circuit implementation of the block 33 of the circuit of FIG. 7.

An example of circuit implementation of the block 33 of the circuit of FIG. 7 is shown in FIG. 8*b*. As can be seen in FIG. 8*b* the block 33 shows the same circuit elements as the block 32 except for the block 34.

Figure 9:
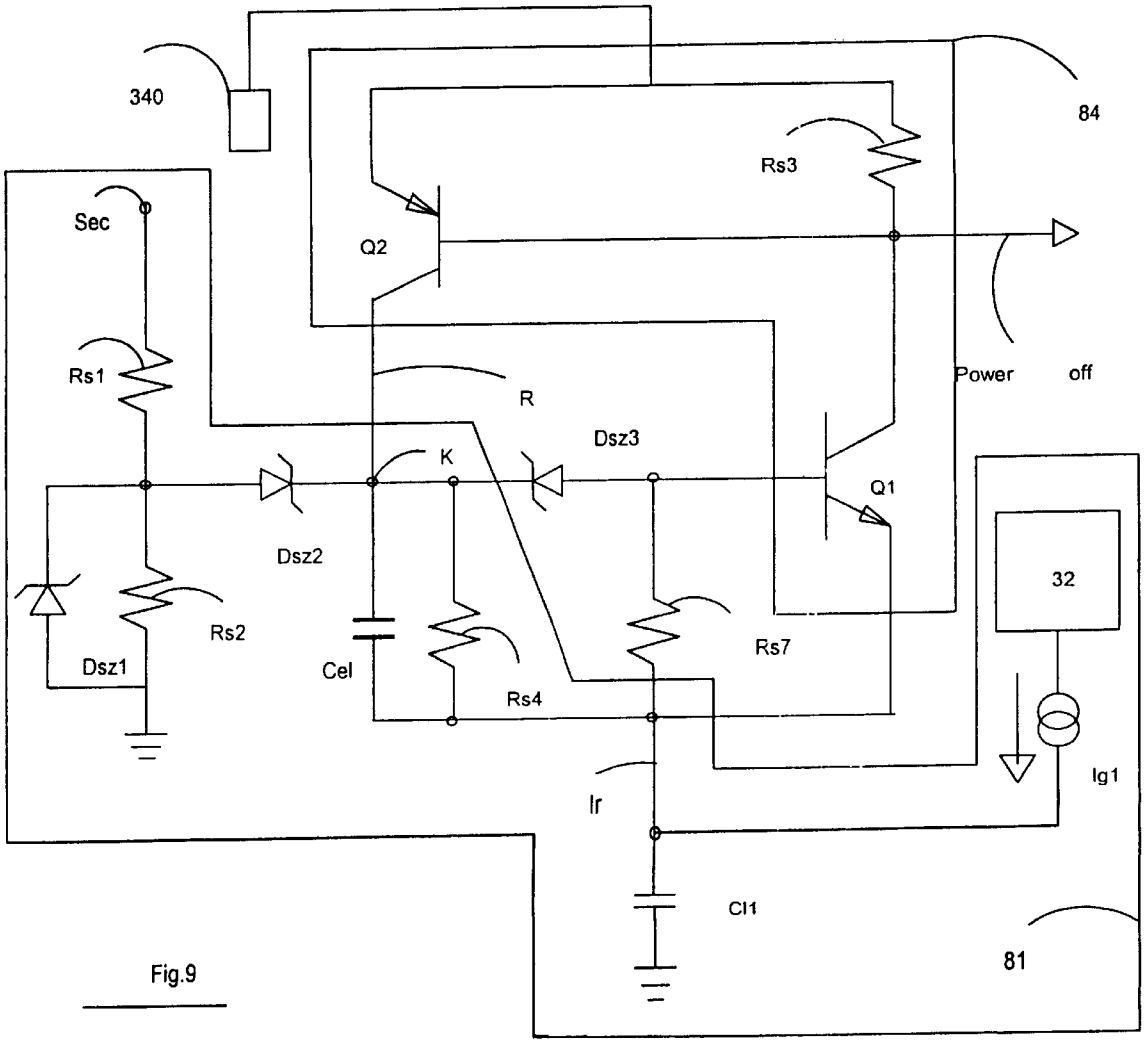
FIG. 9 is a more detailed circuit diagram of the device of FIG. 8.

A more detailed circuit diagram of the device of FIG. 8 is shown in FIG. 9. A first resistor Rs1 connected in series to a second resistor Rs2 connected to ground is connected to the secondary with inductance Ls1 at the terminal Sec. A diode Zener Dsz1 is connected in parallel to the resistor Rs2 and a second diode Zener Dsz2 is connected to the terminal in common of the resistors Rs1 and Rs2 connected in turn to an armature of the capacitor Cel. Another armature of the capacitor Cel is connected to condenser Cf1 connected to ground and connected to a current generator Ig1 connected to the block 32. A third diode Zener Dsz3 in series to a resistor Rs7 and a resistor Rs4 in parallel with the capacitor Cel are connected at the ends of the capacitor Cel. The block 84 is formed by a first bipolar transistor npn Q1 having the emitter terminal connected to the terminal in common of the capacitors Cf1 and Cel, the base terminal connected to the terminal in common of the elements Dsz3 and Rs7, and the collector terminal connected both to the base terminal of a second bipolar transistor pnp Q2 and to a terminal of the resistor Rs3. The emitter terminal of the transistor Q2 is connected to the other terminal of the resistor Rs3 and to the supply mains R1-C4 of the Diac 34, schematized in the figure by a block 340, while the collector terminal is connected to the terminal in common of the elements Dsz2, Dsz3 and Cel.

The condenser Cf1 receives the current Ig1 added to a current Ir coming from the secondary Sec and passes through the elements R1, Dz2 and the only electrolytic capacitor Cel (it is with a very high value capacitance so much so that at high frequencies its impedance is approximately null) given that the resistor Rs4 has a high value. The capacitor Cf1 receiving the current Ig1+Ir loads rapidly and as said capacity controls the frequency fint of the system of switches 35 we have on the circuit L1-C3 a square wave with a frequency f greater than the resonance frequency fr of the circuit L-C; that is the inductive part of the current-voltage characteristic of the circuit is worked on and this entails low voltage values on the condenser C3 such that the lamp is not ignited but a current capable of heating the electrodes F1 and F2 is circulated. With the passing of time the passage of the current Ir on the capacitor Cel loads this capacitor which cannot discharge as Rs4 is a very large resistor and does not permit the discharge of the capacitor Cel in a short time (the capacitor Cel cannot discharge through Rs2 because the diode Dz2 does not permit the passage of inverse current). The voltage at the ends of Cel increases and consequently diminishes the value of the current Ir given that the voltage at the ends of the capacitors Cel and Cf1 becomes similar to the voltage SecRs2/(Rs1+Rs2); this entails the diminishing of the frequency f by Cf1 which tends to the resonance frequency fr of the circuit L-C series. When f=fr and after the ignition of the lamp 1, the voltage on the secondary Ls1 diminishes as the voltage on the primary L1 is low; this entails a low partition voltage SecR2/(R1+R2) and less than the voltage at the ends of the condenser Cel and therefore the current Ir tends to zero. The voltage on the terminal K in common with the capacitor Cel and of the diode Zener Dsz2 can be considered as the voltage Vref1 of FIG. 8 and is a variable voltage. The comparator Comp1, the resistor R10 and the switch 86 are implemented by the complex of the elements R1, R2, Dsz2 and Cel; in fact according to the value of the voltage SecR2/(R1+R2) and of the voltage on the node K we have the passage of the current Ir with a determined value. The capacitor Cf1 implements the block 83 of FIG. 9; in this case the capacitor Cel is not connected to ground but to the capacitor Cf1 to make use of the current Ir that circulated therein as current that enables the variation of the frequency f (nevertheless instead of the capacitor Cf1 it is possible to have a device which is sensitive to Vc and capable of varying the frequency f).

In the part of the circuit of FIG. 9 that implements the end of life function, the element Comp2 is given by the diode Zener Dsz3; the block 84 turns on when the voltage at the ends of the capacitor Cel exceed the voltage value Vbe1+BVDsz3. The connection R of the collector terminal of the transistor Q2 with positive armature of the capacitor Cel implements a function of loading confirmation.

Figure 10:
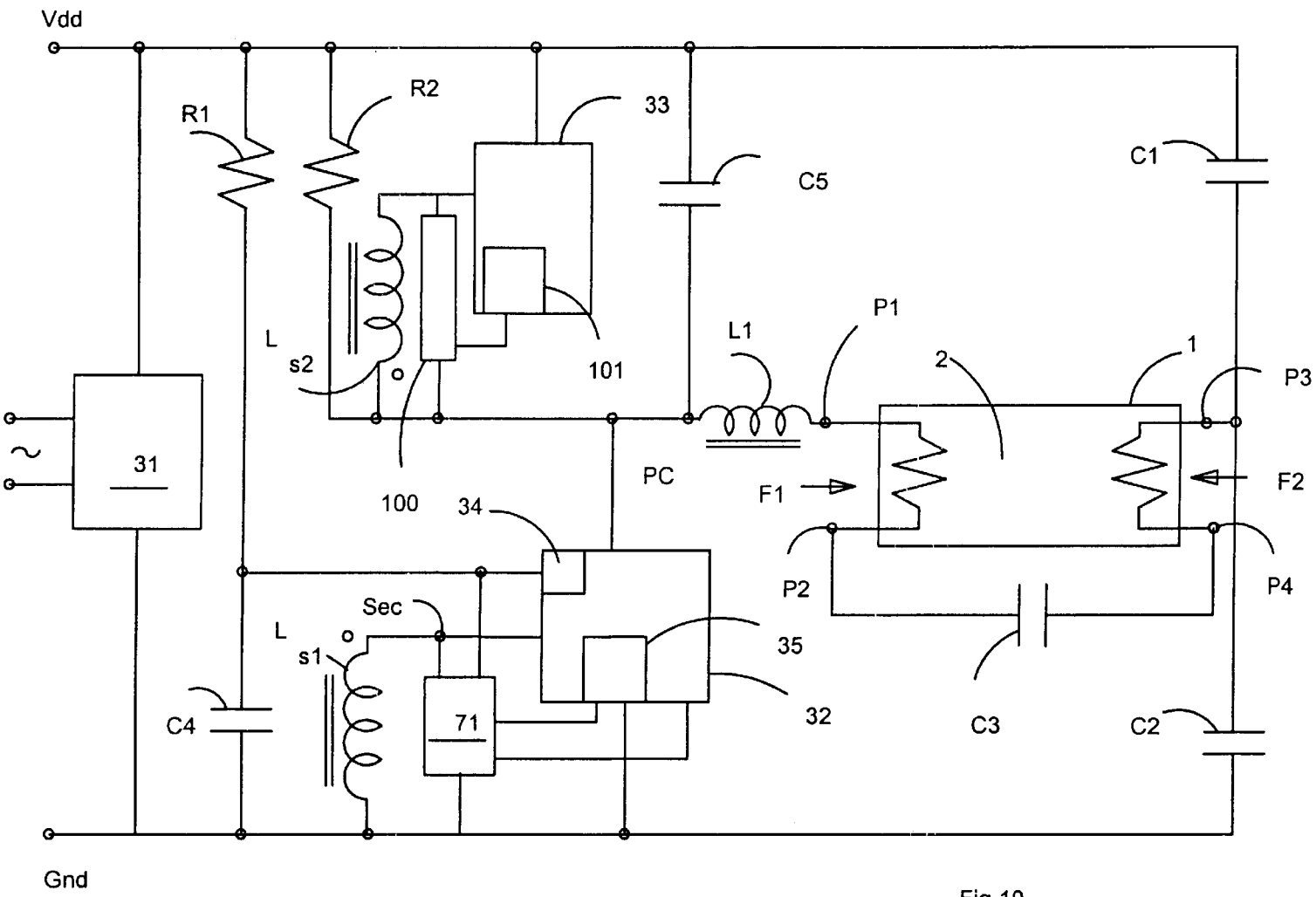
FIG. 10 is a circuit diagram of a driver circuit for the lamp of FIG. 1 according to a variant to the first embodiment of the invention.

A circuit diagram of a driver circuit for the lamp of FIG. 1 is shown in the FIG. 10 according to a variant to the first embodiment of the invention. Said circuit differs from the circuit of FIG. 7 for the presence of a second preheating circuit 100 connected to the block 33 which enables there to be a form of square wave with a duty-cycle of 50% on the node PC which is obtained making the two capacitors Cf1 and Cf2 work alternately.

Figure 11:
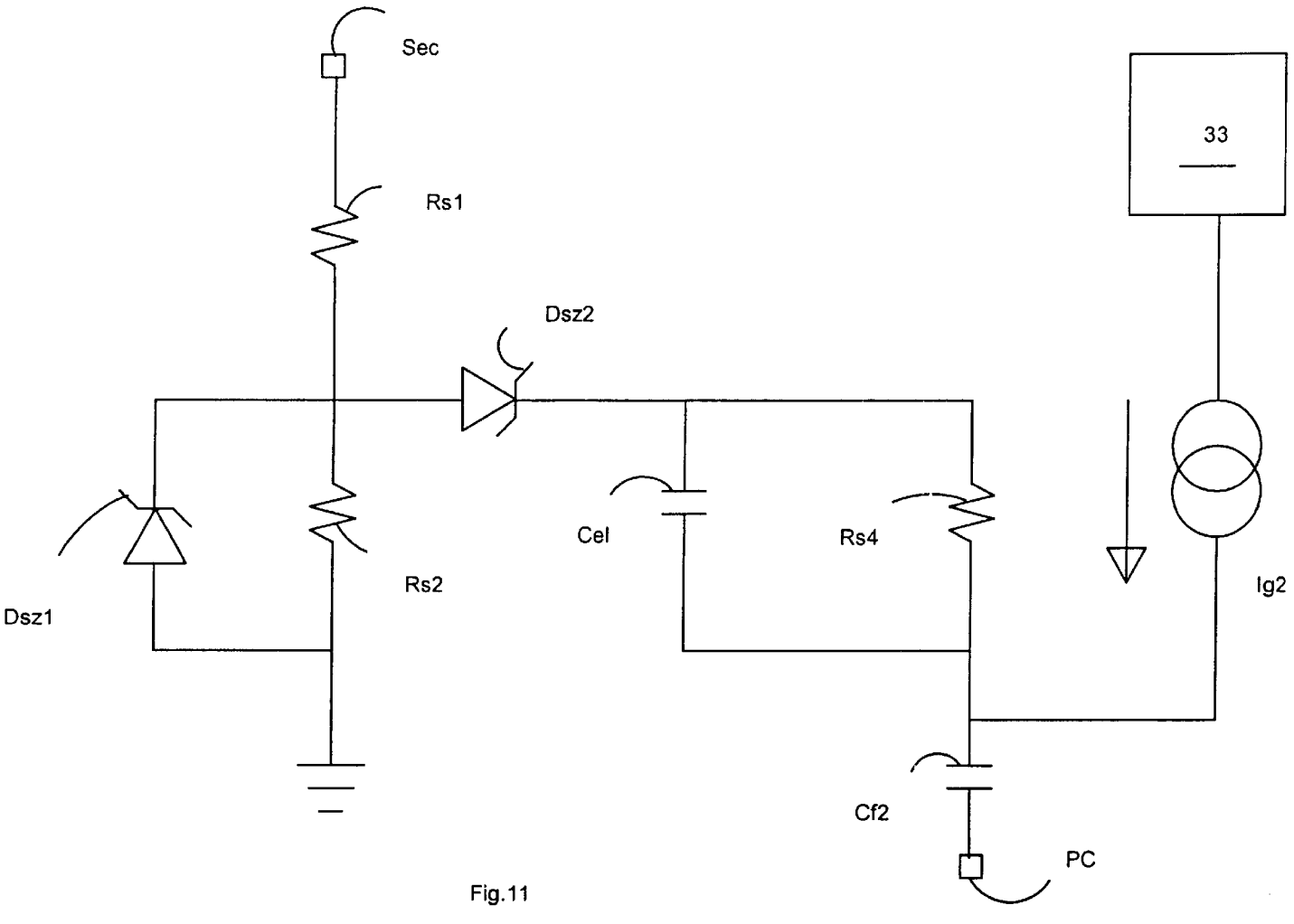
FIG. 11 is a detailed circuit diagram of only the preheating device of FIG. 10.

The circuit diagram of the preheating device 100 is shown in FIG. 11 where it can be seen that it consists of block 81 of the circuit of FIG. 9 without the presence of the block 84 and without the third diode Zener Dsz3 (the terminal of the secondary with inductance Ls2 is indicated with the same reference used for the secondary with inductance Ls1, that is, Sec). In place of the current generator Ig1 and of the condenser Cf1 there is the current generator Ig2 and the condenser Cf2. The device 100 is connected to the secondary with inductance Ls2 and sends a signal in output capable of modulating the frequency of a system of switches 101 of the block 33. The functioning of the preheating circuit 100 is similar to the functioning of the part of the circuit of FIG. 9 that implements the preheating function.

What is claimed is:

1. A driver circuit for a fluorescent lamp having a first and a second electrode and igniting when the voltage between said first and second electrodes exceeds a given threshold voltage, said driver circuit comprising:

an inductance coupled to a supply voltage and to a terminal of said first electrode;

a first condenser coupled to the other terminal of said first electrode and to a terminal of said second electrode;

a control device including a first and a second system of switches for providing an oscillating voltage signal to said inductance and to said first condenser for igniting said lamp; and a preheating device for regulating the frequency of said oscillating signal between the resonance frequency of said inductance and said first condenser and a frequency greater than the resonance frequency of said inductance and of said first condenser in order to provide a preheating of said first and second electrodes, said preheating device being sensitive to the depletion of gas of said lamp and being capable of sending a turn-off signal to said control device.

2. The driver circuit according to claim 1, further comprising an AC/DC converter suitable for converting an input alternating signal to an output direct signal supplying said supply voltage.

3. The driver circuit according to claim 1, further comprising a transformer including a primary and a first and a second secondary, wherein said inductance being the inductance of said primary, said control device comprising a first and a second control device, and said first and second system of switches associated respectively with said first and second control devices, said first and second control devices being associated respectively with said first and second secondaries.

4. The driver circuit according to claim 3, in which said preheating device comprises a preheating device associated only to said first control device.

5. The driver circuit according to claim 4, further comprising a second preheating device for acting on said second system of switches so that said voltage signal has a duty-cycle of about 50%.

6. The driver circuit according to claim 5, in which said second preheating device comprises:

a first circuit block capable of loading a further condenser according to the value of a signal on the second secondary in relation to a first given signal; and a second circuit block sensitive to the variation of the load of said additional condenser and suitable for acting on said second system of switches to control the frequency of said oscillating signal to provide a preheating of said first and second electrode.

7. The driver circuit according to claim 5, in which said second preheating device comprises:

a first and a second resistor connected in series between said second secondary and ground, the terminal in common of said resistors being connected to the anode of a first diode Zener whose cathode is connected to said additional condenser; and a third resistor being placed in parallel to said additional condenser, another condenser having a terminal connected to said additional condenser and to a terminal of a generator of current and having the other terminal connected to ground.

8. The driver circuit according to claim 4, in which said first control device comprises an element coupled to said supply voltage by means of a mains block and capable of emitting a first impulse to provoke said oscillating signal.

9. The driver circuit according to claim 8, in which said first control device comprises:

a first circuit block capable of loading a second condenser according to the value of a signal on the first secondary in relation to a first given signal;

a second circuit block sensitive to the variation of load of said second condenser and suitable for acting on said first system of switches to control the frequency of said oscillating signal to provide a preheating of said first and second electrodes; and a third circuit block capable of sending said turn-off signal to said first control device according to the value of a signal on said second condenser in relation to a second given signal, said first given signal being less than said second given signal.

10. The driver circuit according to claim 9, in which said first circuit block comprises a first comparator suitable for comparing said signal on the first secondary and said first given signal and for acting on a switch capable of connecting or disconnecting said second condenser to said first secondary according to whether said signal on the first secondary is greater or lower than said first given signal; and said third circuit block comprises a second comparator suitable for comparing said signal on said second condenser and said second given signal and capable of igniting a turn-off device if said signal on said second condenser is greater than said second given signal said turn-off device being capable of sending said turn-off signal to said first control device.

11. The driver circuit according to claim 10, characterized in that said preheating device comprises:

a first and a second resistor connected in series between said first secondary and ground, the terminal in common with said resistors being connected to the anode of a first diode Zener whose cathode is connected to said second condenser;

a third resistor being placed in parallel to said second condenser;

a third condenser having a terminal connected to said second condenser and to a terminal of a current generator and having the other terminal connected to ground, wherein said second condenser is connected to said turn-off device, said turn-off device being formed by a first bipolar NPN transistor having the emitter terminal connected to the terminal in common with said second and third condenser, the base terminal connected to the anode of a second diode Zener whose cathode is connected to the cathode of the first diode Zener and to another resistor connected to the emitter terminal, the collector terminal connected to the base terminal of a second bipolar PNP transistor and to a terminal of another resistor, said second bipolar PNP transistor having the collector terminal connected to the cathode of the first diode Zener and the emitter terminal connected to the other terminal of the other resistor and to said mains block.

* * * * *